US007018013B2

(12) United States Patent
Kusunoki

(10) Patent No.: US 7,018,013 B2
(45) Date of Patent: Mar. 28, 2006

(54) INK JET HEAD AND INK JET PRINTER CAPABLE OF PREVENTING VARIATION OF A VOLUME OF AN INK DROPLET DUE TO CROSS TALK

(75) Inventor: Ryutaro Kusunoki, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 177 days.

(21) Appl. No.: 10/659,494

(22) Filed: Sep. 10, 2003

(65) Prior Publication Data

US 2005/0099452 A1 May 12, 2005

(30) Foreign Application Priority Data

Dec. 5, 2002 (JP) ..... 2002-353233

(51) Int. Cl.
*B41J 2/14* (2006.01)
*B41J 2/16* (2006.01)

(52) U.S. Cl. ..... 347/47; 347/70

(58) Field of Classification Search ..... 347/20, 347/44, 42, 43, 45, 47, 54, 56, 63, 65, 40, 347/67, 64, 68, 70–71, 92
See application file for complete search history.

(56) References Cited

U.S. PATENT DOCUMENTS 4,879,568 A 11/1989 Bartky et al. ..... 347/69
5,030,973 A 7/1991 Nonoyama et al. ..... 347/93
5,748,214 A * 5/1998 Usui et al. ..... 347/40
5,774,145 A 6/1998 Morita et al. ..... 347/47
5,975,681 A * 11/1999 Ogasawara et al. ..... 347/47
6,106,106 A 8/2000 Nakazawa et al. ..... 347/68
6,142,607 A * 11/2000 Takata et al. ..... 347/47
6,328,397 B1 12/2001 Shimizu et al. ..... 347/10
6,431,682 B1 * 8/2002 Osada et al. ..... 347/47

FOREIGN PATENT DOCUMENTS

JP 63-252750 A 10/1988
JP 2000-135787 A 5/2000

* cited by examiner

*Primary Examiner*—Juanita D. Stephens
(74) *Attorney, Agent, or Firm*—Frishauf, Holtz, Goodman & Chick, P.C.

(57) ABSTRACT

An ink jet head that varies a capacity in each of plural pressure chambers arranged in parallel, each of which is defined by side walls, each communicating with an ink supplying path, for ejecting an ink droplet from an ejecting nozzle mounted at one end of this pressure chamber is provided with a dummy nozzle that is provided at one end of the pressure chamber positioned at the non-printing region and is set to have an aperture diameter at the ink ejecting side greater than an aperture diameter of the ejecting nozzle and to have a flow impedance approximately same as that of the ejecting nozzle. When the ink droplet is ejected from the ejecting nozzle communicating with the pressure chamber positioned at the end section within the printing region, the capacity in the pressure chamber positioned at the non-printing region is varied simultaneous with the variation of the capacity in the pressure chamber positioned at the end section within the printing region, thereby preventing a variation in volume of the ink droplet ejected from each ejecting nozzle caused by a crosstalk and preventing the occurrence of a non-uniform density or deterioration in image quality.

6 Claims, 7 Drawing Sheets

(PRIOR ART)

INK JET HEAD AND INK JET PRINTER CAPABLE OF PREVENTING VARIATION OF A VOLUME OF AN INK DROPLET DUE TO CROSS TALK

CROSS REFERENCE TO RELATED APPLICATION

The present application is based on Japanese Priority Document JP2002-353233 filed on Dec. 5, 2002 the content of which is incorporated herein by reference.

BACKGROUND OF THE INVENTION

1. Field of the Invention

The present invention relates to an ink jet head and an ink jet printer performing an image formation by ejecting an ink droplet.

2. Discussion of the Background

In a conventional technique, a shear mode ink jet head has been well-known as disclosed in U.S. Pat. No. 4,879,568 wherein a capacity in a pressure chamber is varied by pressure means that produces a shear strain in accordance with an electrical signal for selectively ejecting ink from an ejecting nozzle provided at each pressure chamber, thereby performing an image formation. This type of shear mode ink jet head has a characteristic that the pressure chamber is easy to be arranged with high density.

However, the above-mentioned shear mode ink jet head has a problem that a phenomena so-called crosstalk occurs in which a pressure fluctuation in some pressure chamber gives a fluctuation in a pressure or a flow velocity of the ink in the other nearby pressure chamber. It is considered that the crosstalk occurs because the pressure of the ink in the pressure chamber displaces a partitioning wall between the pressure chambers to thereby change the ink pressure in the adjacent and nearby pressure chambers.

Pressure chambers at the side of both ends within a printing range receive the crosstalk from only the other pressure chambers positioned at the inside within the printing range, while the pressure chambers positioned at the inside of the printing range receive the crosstalk from the other pressure chambers positioned at both sides. Therefore, the influence by the crosstalk is different between the pressure chambers positioned at both sides within the printing range and the pressure chambers positioned at the inside thereof. This leads to a difference between a volume of the ink droplet ejected from an ejecting nozzle communicating with the pressure chambers positioned at both sides within the printing range and a volume of an ink droplet ejected from an ejecting nozzle communicating with the pressure chambers positioned at the inside of the printing range, thereby being likely to cause a non-uniform density or a deterioration in image quality in a printed matter.

There is an ink jet head of FIG. 13 disclosed in, for example, Japanese Unexamined Patent Application No. 2000-135787 as an ink jet head aiming to establish an equalization of the influence of the crosstalk exerted on each pressure chamber. The ink jet head shown in FIG. 13 has three dummy pressure chambers 102 formed respectively at both sides of plural pressure chambers 101 arranged in a printing range, each pressure chamber 101 having a single ejecting nozzle 103 communicating therewith and each dummy pressure chamber 102 having plural dummy nozzles 104 communicating therewith. The "dummy pressure chamber" means herein a pressure chamber from which ink is not ejected even if a driving signal is applied.

When for example, an ink droplet is ejected by changing the capacity in the pressure chamber 101*a* positioned at the edge section within the printing range in the ink jet head shown in FIG. 13, the dummy pressure chamber 102*a* similarly changes its capacity simultaneous with the ejection of the ink droplet. Further, when an ink droplet is ejected by changing the capacity in the pressure chamber 101*b* positioned at the edge section within the printing range, the dummy pressure chamber 102*b* similarly changes its capacity simultaneous with the election of the ink droplet. Further, when an ink droplet is ejected by changing the capacity in the pressure chamber 101*c* positioned at the edge section within the printing range, the dummy pressure chamber 102*c* similarly changes its capacity simultaneous with the ejection of the ink droplet.

This enables to exert the influence of the crosstalk from the other pressure chambers (effective pressure chamber and dummy pressure chamber) positioned at both sides on the pressure chambers 101*a*, 101*b* and 101*c* positioned at the edge sections within the printing range, like the other pressure chambers positioned at the inside of these pressure chambers 101*a*, 101*b* and 101*c*.

However, the ink jet head shown in FIG. 13 has plural dummy nozzles 104 communicating with one dummy pressure chamber 102 in order not to eject an ink droplet from the dummy nozzles 104 in case where the capacity in the dummy pressure chamber 102 is charged.

Therefore, a flow impedance of the dummy nozzle 104 for the dummy pressure chamber 102, i.e., a viscosity resistance, inertial resistance or the like of the ink produced at the dummy nozzle 104 reduces in inverse proportion to the number of the dummy nozzle 104. As a result, a main acoustic resonance frequency of the ink in the dummy pressure chamber 102 differs from that of the ink in the pressure chamber 101.

The main acoustic resonance frequency is a frequency in which, when the pressure chamber is driven by applying voltage with the pressure means, a pressure wave occurring in the ink in the pressure chamber is transmitted through the ink in the pressure chamber and is overlapped to thereby become the greatest pressure vibration. This frequency is called a Helmholtz resonance frequency.

Therefore, when a driving signal having a waveform matched to the acoustic resonance frequency of the ink in the effective pressure chamber 101 is applied to the ink in the dummy pressure chamber 102, an extraordinary pressure fluctuation occurs in the dummy pressure chamber 102, whereby the crosstalk caused by the extraordinary pressure fluctuation occurring in the dummy pressure chamber 102 is exerted on the respective three effective pressure chambers 101 positioned at both end sections within the printing range, thereby rather entailing a problem of bringing non-uniform density or deterioration in image quality depending upon the situation.

SUMMARY OF THE INVENTION

Accordingly, an object of the present invention is to provide an ink jet head and an ink jet printer capable of preventing a variation of a volume of an ink droplet ejected from each ejecting nozzle caused by a crosstalk, thereby being capable of preventing the occurrence of a non-uniform density or deterioration in image quality.

The object of the present invention can be attained by a novel ink jet head and ink jet printer of the present invention.

According to a novel ink jet head of the present invention, an ink jet head that varies a capacity in plurality pressure chambers arranged in parallel, and respect vely communicating with ink supplying paths, each chamber being defined by side walls, wherein the plurality of the pressure chamber comprise a printing region and a non-printing region, thereby ejecting an ink droplet from an ejecting nozzle mounted at one end of this pressure chamber is provided with a dummy nozzle mounted at one end of the pressure chamber positioned in the non-printing region and set to have an aperture diameter at the ink ejecting side greater than an aperture diameter of the ejecting nozzle and to have a flow impedance approximately same as that of the ejecting nozzle. When the ink droplet is ejected from the ejecting nozzle communicating with the pressure chamber positioned at an end of the printing region, the capacity in the pressure chamber in the non-printing region is varied simultaneously.

Further, according to a novel ink jet printer of the present invention, the ink jet head and a recording medium are relatively moved such that the recording medium passes a print position opposite to the ejecting nozzle in the ink jet head, and pressure means and head driving means at the ink jet head are driven based upon a driving signal in accordance with image data.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT(S)

Figure 1:
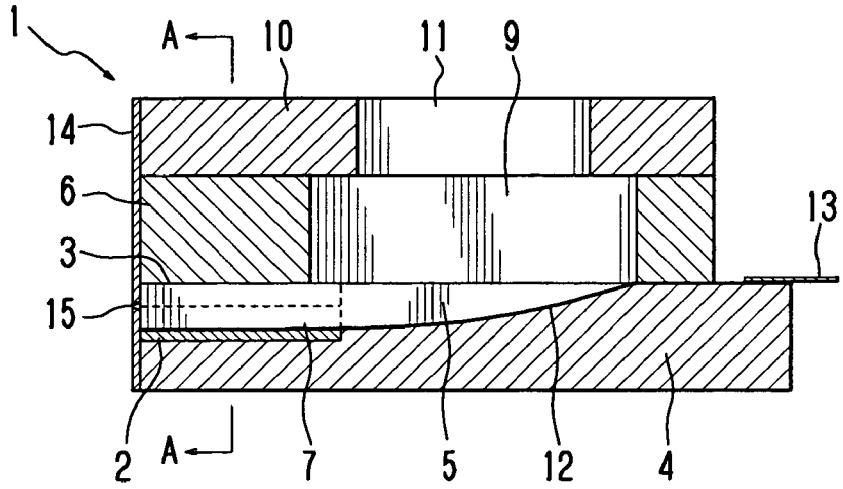
FIG. 1 is a longitudinal side view showing an ink jet head of an embodiment according to the present invention.

An embodiment of the present invention will be explained with reference to FIGS. 1 to 8. FIG. 1 is a longitudinal side view showing an ink jet head, while FIG. 2 is a sectional view taken along a line A—A in FIG. 1.

Figure 2:
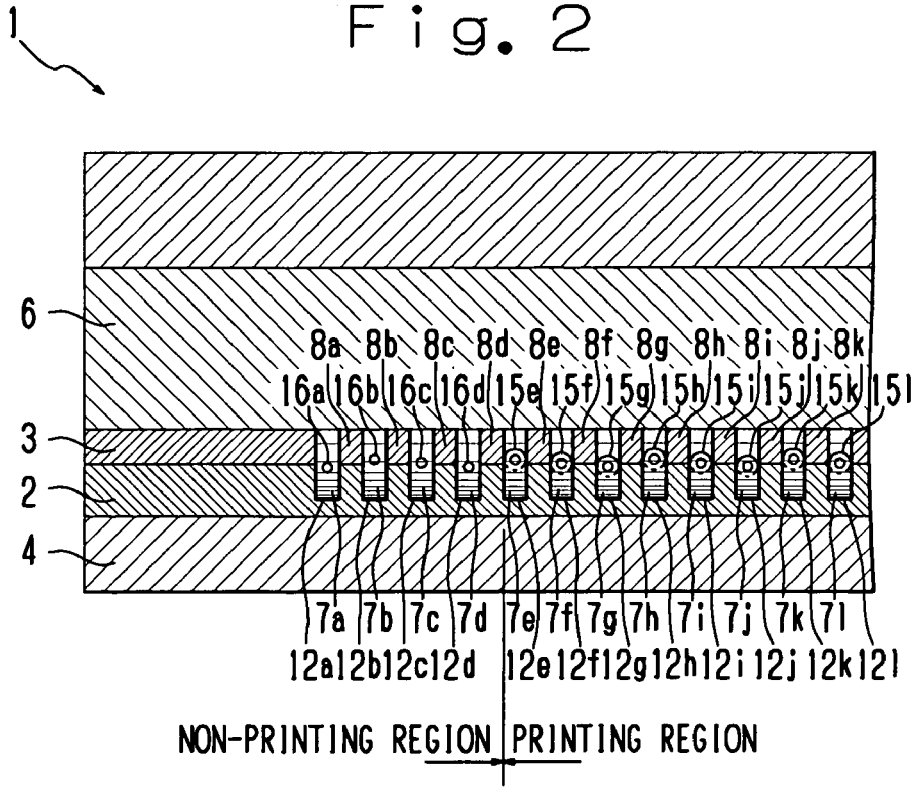
FIG. 2 is a sectional view taken along a line A—A in FIG. 1.

The ink jet head 1 in the present embodiment is provided with two piezoelectric members (lower piezoelectric member 2 and upper piezoelectric member 3) polarized in a direction of a plate thickness as shown in FIGS. 1 and 2. Two piezoelectric members 2 and 3 are laminated with the same polarity opposed to each other. The laminated piezoelectric members 2 and 3 are fixed to a substrate 4 made of a non-polarized low dielectric constant piezoelectric member.

The substrate and the piezoelectric members 2 and 3 fixed to this substrate 4 have plural channels 5 arranged in parallel with the same space. The plural channels 5 are processed by using a diamond cutter or the like.

A top plate frame 6 is adhered on the top surface of the substrate 4. This top plate frame 6 seals a part of the top surface of the channel 5, whereby pressure chambers 7 (7*a*, 7*b*, 7*c* . . . ) are formed.

The space between the adjacent pressure chambers 7 is composed of the lower piezoelectric member 2 and the upper piezoelectric member 3 and is partitioned by side walls 8 (8*a*, 8*b*, 8*c* . . . ) that form pressure means for varying the capacity in the pressure chamber 7 in accordance with a driving signal.

The top plate frame 6 is provided with an ink supplying path 9 that communicates with all pressure chambers 7.

A top plate frame 10 is adhered onto the top surface of the top plate frame 6. This top plate 10 is provided with an ink supplying opening 11 communicating with the ink supplying path 9. Connected to the ink supplying opening 11 is an ink supplying pipe (not shown) for supplying ink to the ink jet head 1.

Provided at the inner surface of each channel 5 are electrodes 12 (12*a*, 12*b*, 12*c*, . . . ) electrically independent to one another. The electrode 12 in this embodiment is made by non-electrolysis nickel plating. Each electrode 12 is connected to a driver IC (not shown) that is driving means via a flexible cable 13 connected to the rear end section of the substrate 4.

A nozzle plate 14 made of polyimide is adhered onto the front side of the pressure chamber 7. Mounted at this nozzle plate 14 are ejecting nozzles 15 (15*e*, 15*f*, 15*g*, . . . ) and dummy nozzles 16 (16*a*, 16*b*, 16, 16*d*). The ejecting nozzles 15 and the dummy nozzles 16 in this embodiment are formed by a laser processing. The laser processing of the ejecting nozzles 15 and the dummy nozzles 16 to the nozzle plate 14 is performed after the nozzle plate 14 is adhered on the front side of the pressure chamber 7.

The ejecting nozzles 15 are formed at the positions opposite to the pressure chambers 7 (7*e*, 7*f*, 7*g*, . . . ) positioned within the printing range. The dummy nozzles 16 are formed at the positions opposite to the pressure chambers 7 (7*a*, 7*b*, 7*c*, 7*d*) positioned at the outside of the printing range.

It is to be noted that FIG. 2 shows only one end section of the ink jet head 1, and formed at the other end section of the ink jet head 1 are also four pressure chambers 7 positioned at the outside of the printing range and four dummy nozzles 16 positioned so as to oppose to these pressure chambers 7.

Ink is injected through the ink supplying pipe to the ink jet head 1 from the ink supplying opening 11, and then, filled in the ink supplying path 9, pressure chambers 7, ejecting nozzles 15 and dummy nozzles 16.

Figure 3A:
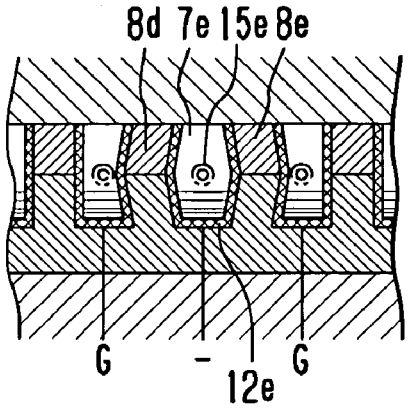
FIGS. 3A and 3B are explanatory views showing a state of a capacity change in a pressure chamber due to a shearing strain.
Figure 3B:
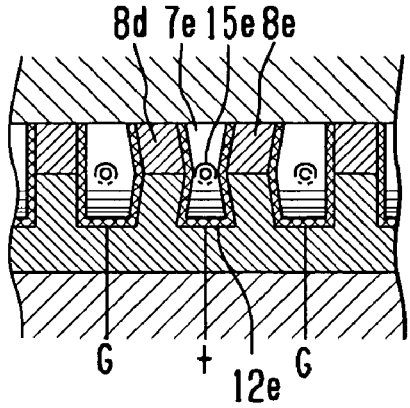

When a negative driving signal with respect to the terminals G is applied from the driver IC to the electrode 12*e*, for example, in the ink jet head 1 having the above-mentioned construction, an electric field perpendicular to the polarizing direction occurs at the side walls 8*d* and 8*e*. The side walls 8*d* and 8*e* respectively bend in the opposite direction for increasing the capacity in the pressure chamber 7*e* as shown in FIGS. 3A and 3B due to an inverse piezoelectric effect caused by the electric field perpendicular to the polarizing direction, thereby producing a shear strain. This increases the capacity in the pressure chamber 7*e* (FIG. 3A). Further, when a positive driving signal with respect to the terminals G is applied to the electrode 12*e* from the driver IC, the capacity in the pressure chamber 7*e* is decreased on the contrary (FIG. 3B). As described above, applying the driving signal to the electrode 12*e* enables the capacity in the pressure chamber 7*e* to be selectively varied. When the capacity in the pressure chamber 7*e* increases, the pressure of the ink in the pressure chamber 7*e* is reduced, thereby causing a pressure fluctuation starting with a negative polarity in the ink in the pressure chamber. Further, when the capacity in the pressure chamber 7*e* decreases, the pressure of the ink in the pressure chamber 7*e* is increased, thereby causing a pressure fluctuation starting with a positive polarity in the ink in the pressure chamber 7*e*. The ink in the pressure chamber 7*e* is ejected from the ejecting nozzle 15*e* as ink droplets when the pressure fluctuations overlap with each other to thereby increase the pressure of the ink in the pressure chamber 7*e*.

Figure 4A:
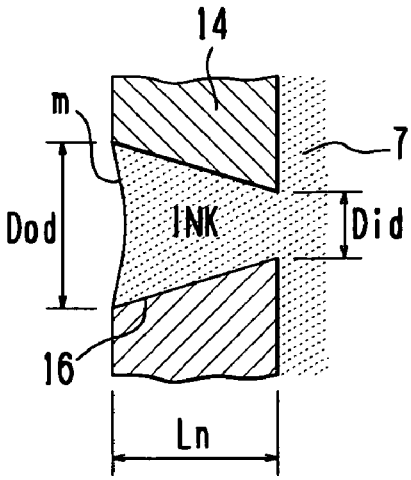
FIGS. 4A and 4B are sectional views showing shapes of an ejecting nozzle and a dummy nozzle.
Figure 4B:
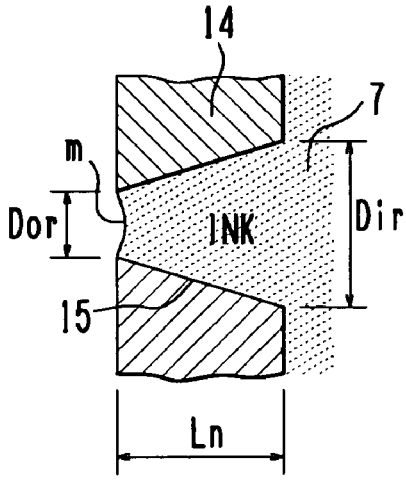

Subsequently, the dummy nozzle 16 and the ejecting nozzle 15 are explained. FIGS. 4A and 4B are sectional views showing shapes of the dummy nozzle 16 and the ejecting nozzle 15. The dummy nozzle 16 has a shape wherein the diameter of the nozzle is widened toward the ink ejecting direction. The ejecting nozzle 15 has, contrary to the dummy nozzle 16, a shape wherein the diameter of the nozzle is narrowed toward the ink ejecting direction.

An aperture diameter Dod of the dummy nozzle 16 at the outlet side is set such that it is approximately the same as an aperture diameter Dir of the ejecting nozzle 15 at the inlet side. An aperture diameter Did of the dummy nozzle 16 at the inlet side is set such that it is approximately the same as an aperture diameter Dor of the ejecting nozzle 15 at the outlet side. The ejecting nozzle 15 and the dummy nozzle 16 are formed so as to have a symmetrical taper shape with respect to the direction in which the ink droplet are ejected.

One preferable example of sizes of the dummy nozzle 16 and the ejecting nozzle 15 is as follows:

Aperture Diameter Dod at the outlet side of the dummy nozzle 16: 54 micrometers Aperture Diameter Did at the inlet side of the dummy nozzle 16: 27 micrometers Aperture Diameter Dor at the outlet side of the ejecting nozzle 15: 27 micrometers Aperture Diameter Dir at the inlet side of the ejecting nozzle 15: 54 micrometers Length of nozzle (dummy nozzle 16, ejecting nozzle 15) Ln: 50 micrometers In this case, the ratio of the sectional area of the dummy nozzle 16 at the outlet side to the sectional area of the ejecting nozzle 15 at the outlet side is 4:1 since it is in proportion to the square of each diameter. Specifically, the flow velocity of the ink in the dummy nozzle 16 is one fourth the flow velocity of the ink in the ejecting nozzle 15 at the position of an ink meniscus m. Accordingly, ink droplets are not ejected from the dummy nozzle 16 even if the pressure of the ink in the pressure chambers 7*a* to 7*d* increases.

Moreover, when the diameter at the outlet side increases like the dummy nozzle 16, force that the ink meniscus m holds its position by a surface tension of the ink is weakened, but its static negative pressure limit Ps becomes −2222 Pa when calculated by using a formula (1), $$Ps = -\frac{4\sigma}{Doi} \tag{1}$$

wherein the surface tension (σ) of the ink is 30 mN/m.

An ink hydrostatic pressure at the nozzle surface is required to be maintained within 0 to −2222 Pa, but normally, an ink supplying pressure is adjusted to have the ink hydrostatic pressure at the nozzle surface of −1000 Pa, thus there is no problem.

Further, even if the ink hydrostatic pressure becomes instantaneously less than the negative pressure limit Ps, the nozzle diameter becomes small as the ink meniscus m retreats in the dummy nozzle 16, to thereby increase the negative pressure limit, with the result that the force for recovering the ink meniscus m to the original position is strengthened.

Therefore, the ink meniscus m retreats to the inside of the pressure chamber 7 and an air bubble is caught in the pressure chamber 7, whereby the negative pressure limit that causes a malfunction of the ink jet head 1 is the same as that of the ejecting nozzle 15.

Figure 5A:
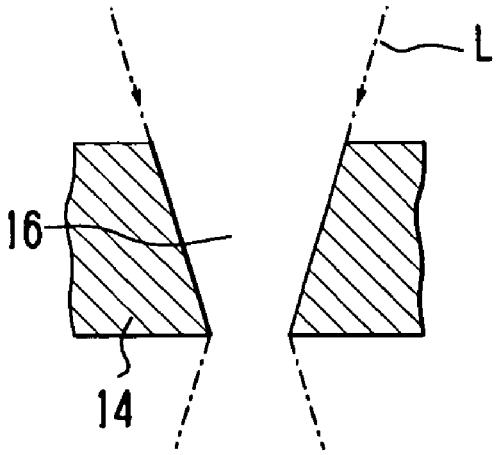
FIGS. 5A and 5B are explanatory views for explaining a process for forming the ejecting nozzle and the dummy nozzle.
Figure 5B:
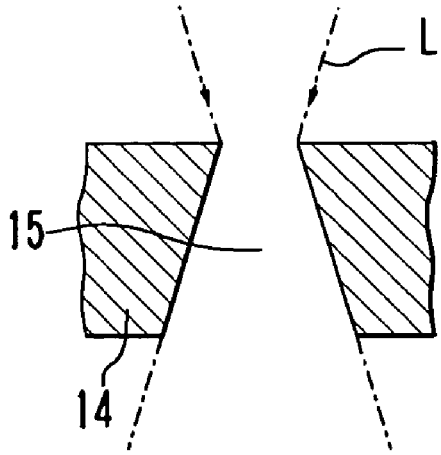

The above-mentioned dummy nozzle 16 and the ejecting nozzle 15 are easily formed by a process using laser beam L. Specifically, a laser irradiating device having an imaging optical system is utilized, wherein a relative position of a laser projection lens and the nozzle plate 14 is varied by an xyz stage, and when the dummy nozzle 16 is formed, a laser converging surface is matched to the bottom surface of the nozzle plate 14 by the adjustment of the z stage as shown in FIG. 5A, while the laser converging surface is matched to the top surface of the nozzle plate 14 by the adjustment of the z stage as shown in FIG. 5B when the ejecting nozzle 15 is formed.

The acoustic characteristics of the dummy nozzle 16 and the ejecting nozzle 15 are as follows. When the following definitions are made in the ejecting nozzle 15 in FIG. 6B:

p(t): ink pressure at the inlet of the nozzle q(t): ink flow rate at the inlet of the nozzle M: inertial resistance of the ink in the nozzle R: viscosity resistance of the ink in the nozzle (ρ): density of the ink y(x): radius of the nozzle at the position x r(y) pressure gradient due to the viscosity per unit flow rate of the ink flowing through a cylinder with a radius y Ln: length of the nozzle an equation of motion $$P(t) = M\frac{dl}{dt}q(t) + Rq(l) \tag{2}$$

relating to the ink in the nozzle is established wherein $$M = \frac{\rho}{\pi}\pi\int_0^{Ln}\frac{1}{y(x)^2}\,dx. \tag{3}$$

It is understood from the formula (2) that the acoustic characteristic of the nozzle for the pressure chamber 7, i.e., the flow impedance is characterized by the inertial resistance M and the viscosity resistance R.

Figure 6A:
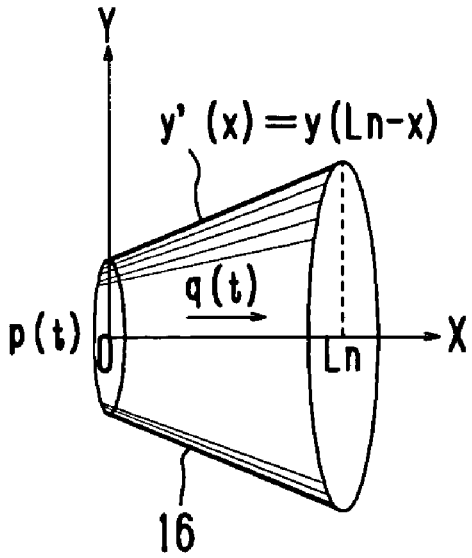
FIGS. 6A and 6B are explanatory views showing a calculation model of a flow impedance of the ejecting nozzle and the dummy nozzle.
Figure 6B:
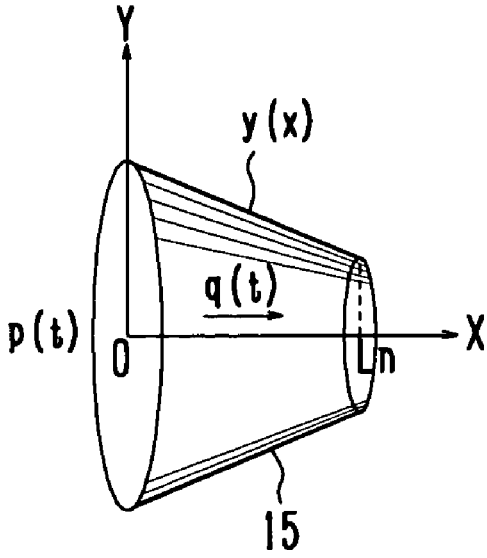

Considering here an inertial resistance M' and a viscosity resistance R' of the dummy nozzle 16 that is opposite in direction to the ejecting nozzle 15 as shown in FIG. 6A, a following formula (4) is obtained.

$$R = \int_0^{Ln} r(y(x))\,dx \tag{4}$$

$$M' = \frac{\rho}{\pi}\int_0^{Ln} \frac{1}{y'(x)^2}\,dx = \frac{\rho}{\pi}\int_0^{Ln} \frac{1}{y(Ln-x)}\,dx = \frac{\rho}{\pi}\int_0^{Ln} \frac{1}{y(x)}\,dx = M \tag{5}$$

$$R' = \int_0^{Ln} r(y'(x))\,dx = \int_0^{Ln} r(y(Ln-x))\,dx = \int_0^{Ln} r(y(x))\,dx = R \tag{6}$$

It is understood from above formulas (5) and (6) that the inertial resistances M, M' and the viscosity resistances R, R' of the ejecting nozzle 15 and the dummy nozzle 16 each having an opposite shape in direction to each other are the same, which means that the flow impedances of both nozzles are the same.

Accordingly, in case where the outlet diameter Dod of the dummy nozzle 16 is approximately the some as the inlet diameter Dir of the ejecting nozzle 15 and the inlet diameter Did of the dummy nozzle 16 is approximately the same as the outlet diameter Dor of the ejecting nozzle 15 as disclosed in the present embodiment, the dummy nozzle 16 and the ejecting nozzle 15 have approximately the same flow impedance.

This enables to make the pressure vibration characteristic of the pressure chambers 7*b* to 7*d* at the non-printing region approximately equal to the pressure vibration characteristic of the pressure chambers 7*e*, 7*f*, . . . positioned within the printing range, and further enables to make the main acoustic resonance frequency of the ink in the pressure chambers 7*b*, 7*c*, . . . approximately equal thereto.

Further, in case where a suction operation of the ink is performed from the ejecting nozzle 15 and the dummy nozzle 16 upon the maintenance of the ink jet head 1, more ink than necessary is made to flow from the dummy pressure chamber in the conventional ink jet head provided with plural dummy nozzles in the dummy pressure chamber.

On the other hand, more ink than necessary is not made to flow from the dummy pressure chamber in the present embodiment since the dummy nozzle 16 and the ejecting nozzle 15 have the same viscosity resistance. This enables to reduce a waste of ink upon the maintenance.

Figure 7:
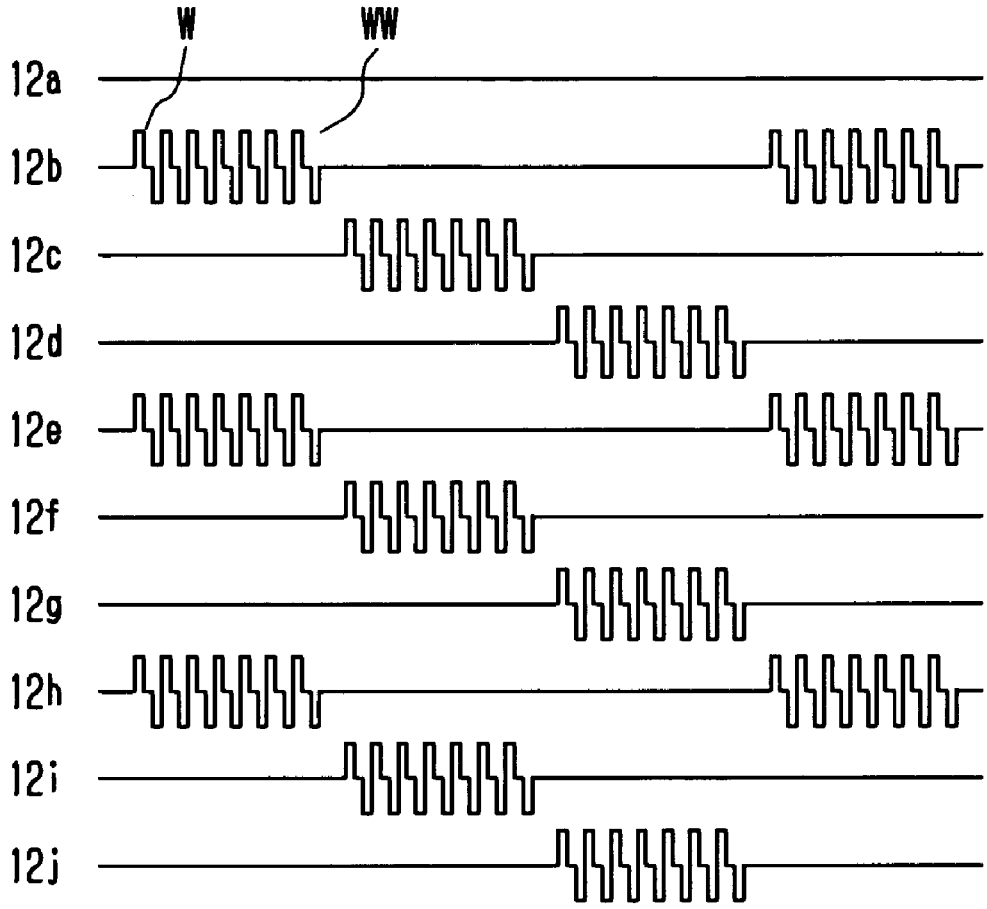
FIG. 7 is a timing chart of a driving waveform outputted to an electrode.
Figure 8:
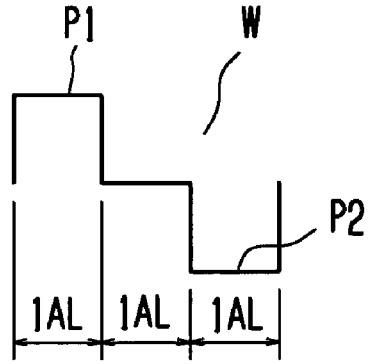
FIG. 8 is an explanatory view showing a detail of the driving waveform.

FIG. 7 is a timing chart of a driving signal WW outputted from the driver IC to the electrode 12 in a black solid printing. The driving signal is not applied to the electrode 12*a* which consequently has a constant potential. Applied at all times to the electrode 12*b* is a potential some as that applied to the electrode 12*e*. Applied at all times to the electrode 12*c* is a potential same as that applied to the electrode 12*f*. Applied at all times to the electrode 12*d* is a potential same as that applied to the electrode 12*g*. Although FIG. 7 shows only one end section of the ink jet head 1, the same is applied to the other end section of the ink jet head 1.

The driving signal is time-shared in three phases. When ink is ejected from some nozzle 15, ink is not ejected from the next-door nozzles on both sides of the nozzle ejecting ink and is not ejected further from the adjacent nozzles of the next-door nozzles.

The driving signal WW is made of seven drop signals W continuously arranged. When this driving signal WW is applied to the pressure chamber 7, one ink droplet is ejected from the ejecting nozzle 15 per one drop signal. In case where the number of the drop signal W is seven in the driving signal WW, for example, seven ink droplets are continuously elected from the ejecting nozzle 15 for a single driving signal WW. Accordingly, if the amount of the ink droplet adhered on one pixel is intended to be changed, the number of the drop signal W in the driving signal WW may be changed. This construction can perform a printing of 8-tone including the case where ink is not ejected.

The drop signal W is made of an expanding pulse P1 for expanding the capacity of the pressure chamber 7, a contracting pulse P2 for contracting the capacity of the pressure chamber 7 and a quiescent period between both pulses. The width of the expanding pulse P1, the quiescent period and the width of the contracting pulse P2 are respectively 1 AL. The AL means here a time that is half the main acoustic resonance period of the ink in the pressure chamber 7, i.e., a time for inverting the average of the pressure of the ink in the pressure chamber 7 from a positive value to a negative value or from a negative value to a positive value. The main acoustic resonance frequency that is the inverse of the main acoustic resonance period of the ink in the pressure chamber 7 is called Helmholts resonance frequency. The expanding pulse P1 ejects ink from the ejecting nozzle 15, while the contracting pulse 22 has an effect of killing the pressure vibration produced by the expanding pulse P1.

As described before, the present invention can approximately match the main acoustic resonance period of the ink in the pressure chamber 7, with which the dummy nozzle 16 is made to communicate, to the main acoustic resonance period of the ink in the pressure chamber 7 with which the ejecting nozzle 15 is made to communicate. Strictly speaking, there may be a possibility that both main acoustic resonance periods are delicately different from each other since the shape in the vicinity of the nozzle (dummy nozzle 16, ejecting nozzle 15) is different between the pressure chamber 7 with which the dummy nozzle 16 communicates and the pressure chamber 7 with which the ejecting nozzle 15 communicates. This difference hardly matters in the case of ejecting one droplet. However, in case where plural ink droplets are continuously ejected as in the present embodiment, the timing of the driving signal W may be matched to the main acoustic resonance period of the ink in the pressure chamber 4 with which the ejecting nozzle 15 is made to communicate.

In this configuration, the potentials of the electrode 12*b* and the electrode 12*e*, the potentials of the electrode 12*c* and the electrode 12*f*, the potentials of the electrode 12*d* and the electrode 12*g* are respectively the same, so that when the shear strain occurs at the partitioning walls 8*d* and Be of the pressure chamber 7*e*, the shear strain simultaneously occurs at the side walls 8*a* and 8*b* of the pressure chamber 7*b*. Further, when the shear strain occurs at the partitioning walls 8*e* and 8*f* of the pressure chamber 7*f*, the shear strain simultaneously occurs at the side walls 8*b* and 8*c* of the pressure chamber 7*c*. Additionally, when the shear strain occurs at the side walls 8*f* and 8*g* of the pressure chamber 7*g*, the shear strain simultaneously occurs at the side walls 8*c* and 8*d* of the pressure chamber 7*d*. Even if the pressure chambers 7*b*, 7*c* and 7*d* have the shear strain, ink is not ejected since the dummy nozzles 16*b*, 16*c* and 16*d* communicate with the pressure chambers 7*b*, 7*c* and 7*d*. However, the flow impedances of the dummy nozzle 16 and the ejecting nozzle 15 are approximately the same, with the result that the pressure vibration approximately same as that in the pressure chambers 7*c*, 7*f*, 7*g* . . . is produced in the pressure chambers 7*b*, 7*c* and 7*d*. Therefore, the amplitude of the crosstalk leaked from the pressure chambers 7*b*, 7*c* and 7*d* also becomes the same as the amplitude of the crosstalk leaked from the pressure chambers 7*e*, 7*f*, 7*g* . . . . Accordingly, upon the black solid printing, the pressure chambers 7*e*, 7*f* and 7*g* positioned at the end of the printing region receive the crosstalk of the same amplitude from both sides like the other pressure chambers 7*h*, 7*i*, 7*j* . . . positioned at the inside of the printing region. Accordingly, the volume of the ink droplet ejected from the ejecting nozzles 15*e*, 15*f* and 15*g* can be made approximately equal to the volume of the ink droplet ejected from the ejecting nozzles 15*h*, 15*i*, 15*j*, . . . . Consequently, a non-uniform density at the end of the printing region and deterioration in image quality can be prevented.

Figure 9A:
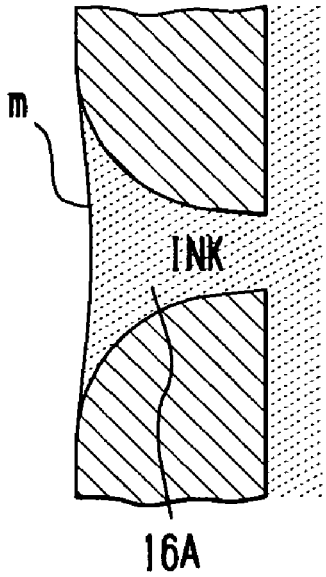
FIGS. 9A and 9B are sectional views showing a modified example of the ejecting nozzle and the dummy nozzle.
Figure 9B:
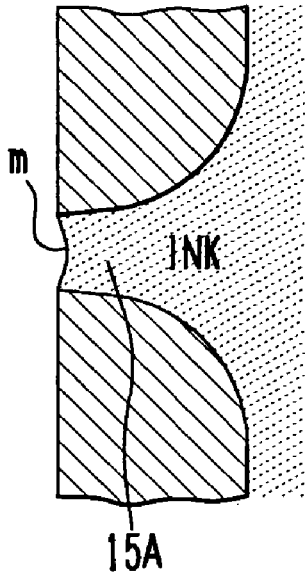

Although the above-mentioned embodiment makes an explanation taking as an example the ejecting nozzle 15 and the dummy nozzle 16 both having the linear taper shape in the inner peripheral surface, the inner peripheral surface of an ejecting nozzle 15A and a dummy nozzle 16A may be formed like a curved taper shape as shown in FIGS. 9A and 9B. In this case, the ejecting nozzle 15A and the dummy nozzle 16A are formed such that the taper shape becomes symmetrical with respect to the ink ejecting direction, thereby being capable of making the flow impedances of the ejecting nozzle 15A and the dummy nozzle 16A approximately equal as described above.

Subsequently, another embodiment of the present invention will be explained with reference to FIGS. 10 to 12. It is to be noted that the same parts as the embodiment 1 are given by the same numerals for omitting the explanation thereof.

Figure 10:
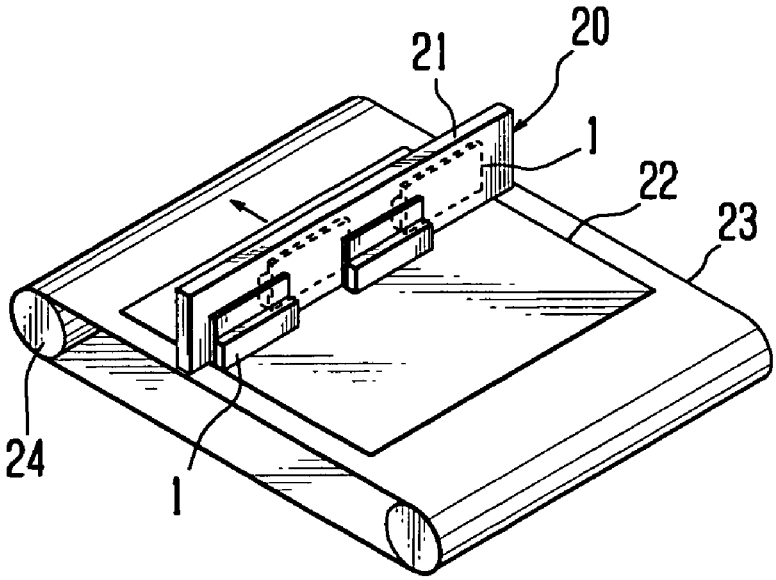
FIG. 10 is a perspective view showing a part of an ink jet printer according to another embodiment of the present invention.
Figure 11:
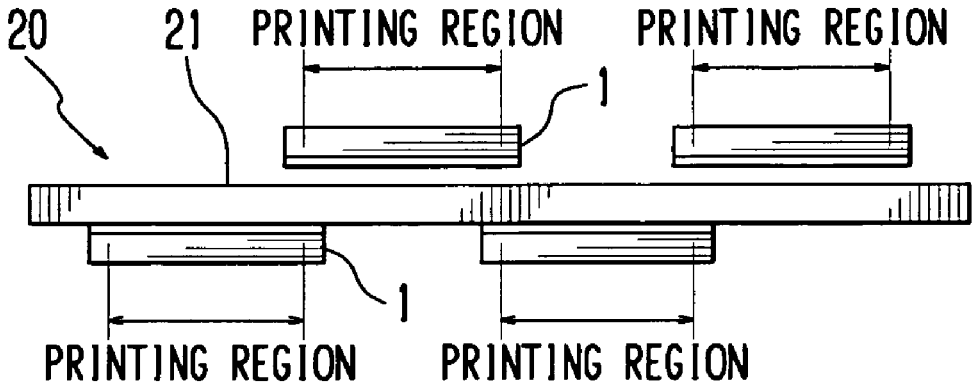
FIG. 11 is an explanatory view showing a holding state of an ink jet head at a head holding member provided at the ink jet printer of another embodiment according to the present invention.

FIG. 10 is a perspective view showing a part of an ink jet printer of another embodiment according to the present invention. The ink jet printer is provided with a line ink jet head 20. The line ink jet head 1 has plural ink jet heads 1 arranged in a line and a head holding member 21 for holding these ink jet heads 1. The plural ink jet heads 1 are arranged along the arrangement direction of the ejecting nozzle and the dummy nozzle at the head holding member 21 as shown in FIG. 11. The ink jet heads 1 are arranged alternately with respect to both surfaces of the plate-like head holding member 21. This can arrange the printing range of each ink jet head 1 along the arrangement direction of the ink jet head 1 without a space.

The ink jet printer has a sheet transporting belt 23 for transporting recording sheet 22 such that the sheet 23 passes the position opposite to the ink jet head 1 held by the head holding member 21. The sheet transporting belt 23 in the present embodiment has an endless belt shape wound around a pair of rollers 24. A driving mechanism such as a motor or the like not shown is connected to at least one of the pair of rollers 24. The sheet transporting belt 23 is rotated by rotatably driving at least one of the rollers 24 by the driving mechanism to thereby transport the recording sheet 22. Upon transporting the recording sheet 22 by the sheet transporting belt 23, the recording sheet 22 is adsorbed to the sheet transporting belt 23 by static electricity or airflow, or the edge section of the recording sheet 22 is held by a holding member not shown, so that the recording sheet 22 comes in close contact with the sheet transporting belt 23. A method for bringing the recording sheet 22 into close contact with the sheet transporting belt 23 is a well-known technique, so that its explanation is omitted.

Figure 12:
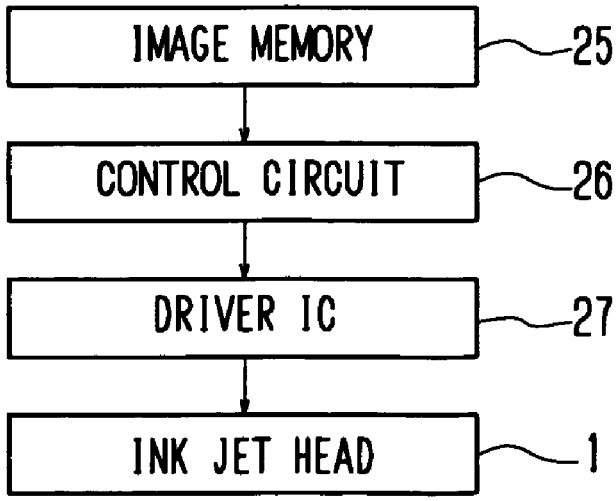
FIG. 12 is a block diagram showing various electric circuits provided at the ink jet printer of another embodiment of the present invention and a relationship among these electric circuits.
Figure 13:
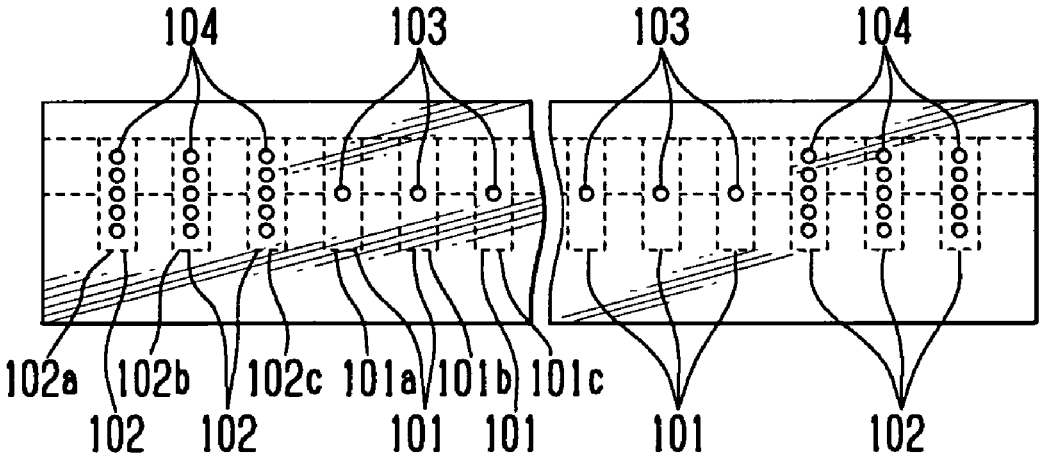
FIG. 13 is a front view showing a conventional ink jet head (Prior art).

FIG. 12 is a block diagram showing various electric circuits provided at the ink jet printer of another embodiment of the present invention and a relationship among these electric circuits. The ink jet printer has an image memory 25 that stores image data printed on the recording sheet 22. A control circuit 26 reads the image data stored in the image memory 25 in a predetermined order when the recording sheet 22 transported by the sheet transporting belt 23 passes the position opposite to the ink jet head 1, and transmits a print signal according to the read-out image data to a driver IC 27. The driver IC 27 outputs the driving signal WW having a predetermined shape to the corresponding ink jet head 1. This enables a printing according to the number of the drop signal W or the like in each driving signal WW like the above-mentioned disclosure.

Obviously, numerous modifications and variations of the present invention are possible in light of the above teachings. It is therefore to be understood that within the scope of the appended claims, the invention may be practiced otherwise than as specifically described herein.

What is claimed is:

1. An ink jet head comprising:

a plurality of pressure chambers arranged in parallel, each of which is defined by side walls and communicates with an ink supplying path, wherein the plurality of pressure chambers comprise a plurality of pressure chambers in a printing region and at least one pressure chamber in a non-printing region;

an ejecting nozzle provided at one end of each of the pressure chambers in the printing region;

pressure means for varying a capacity in each of the plurality of pressure chambers in accordance with a respective driving signal;

a dummy nozzle provided at one end of said at least one pressure chamber in the non-printing region, said dummy nozzle having (i) a shape for preventing ink from being elected therefrom which includes an aperture area at an ink ejecting side thereof which is greater than an aperture area of the ejecting nozzle at an ink ejecting side thereof, and (ii) a flow impedance which is substantially the same as a flow impedance of the ejecting nozzle, said flow impedance varying in accordance with both an inertial resistance of ink in the nozzle and a viscosity resistance of ink in the nozzle; and head driving means that selectively varies the capacity in the pressure chambers in the printing region by applying respective driving signals to the pressure means, to eject ink from the ejecting nozzles;

wherein when the head driving means varies the capacity in a pressure chamber of the plurality of pressure chambers in the printing region which is positioned at an end of the printing region, the head driving means simultaneously varies the capacity in a corresponding said at least one pressure chamber in the non-printing region by applying a driving signal to the pressure means.

2. An ink jet head according to claim 1, wherein an aperture diameter of the ejecting nozzle at a pressure chamber side thereof is greater than an aperture diameter at the ink electing side thereof, and an aperture diameter of the dummy nozzle at a pressure chamber side thereof is smaller than an aperture diameter at the ink ejecting side thereof.

3. An ink jet head according to claim 2, wherein the ejecting nozzle and the dummy nozzle each have symmetrical shapes with respect to an ejecting direction of an ink droplet.

4. An ink jet printer comprising:

(i) an ink jet head comprising:

a plurality of pressure chambers arranged in parallel, each of which is defined by side walls and communicates with an ink supplying path, wherein the plurality of pressure chambers comprise a plurality of pressure chambers in a printing region and at least one pressure chamber in a non-printing region;

an ejecting nozzle provided at one end of each of the pressure chambers in the printing region;

pressure means for varying a capacity in each of the plurality of pressure chambers in accordance with a respective driving signal;

a dummy nozzle provided at one end of said at least one pressure chamber in the non-printing region, said dummy nozzle having (i) a shape for preventing ink from being ejected therefrom which includes an aperture area at an ink ejecting side thereof which is greater than an aperture area of the ejecting nozzle at an ink ejecting side thereof, and (ii) a flow impedance which is substantially the same as a flow impedance of the ejecting nozzle, said flow impedance varying in accordance with both an inertial resistance of ink in the nozzle and a viscosity resistance of ink in the nozzle; and head driving means that selectively varies the capacity in the pressure chambers in the printing region by applying the driving signal to the pressure means, to eject ink from the ejecting nozzle;

wherein when the head driving means varies the capacity in a pressure chamber of the plurality of pressure chambers in the printing region which is positioned at an end of the printing region, the head driving means simultaneously varies the capacity in a corresponding said at least one pressure chamber in the non-printing region by applying a driving signal to the pressure means;

(ii) moving means for relatively moving the ink jet head with respect to a recording medium such that the recording medium passes through a print position opposite to the ejecting nozzle; and (iii) drive control means for driving the pressure means and the head driving means in accordance with image data.

5. An ink jet printer according to claim 4, wherein the an aperture diameter of the ejecting nozzle at a pressure chamber side thereof is greater than an aperture diameter at the ink ejecting side thereof, and an aperture diameter of the dummy nozzle at a pressure chamber side thereof is smaller than an aperture diameter at the ink ejecting side thereof.

6. An ink jet printer according to claim 5, wherein the ejecting nozzle and the dummy nozzle each have symmetrical shapes with respect to an ejecting direction of an ink droplet.

* * * * *